US005809866A

United States Patent [19]

Brascher F. et al.

[11] Patent Number: 5,809,866

[45] Date of Patent: Sep. 22, 1998

[54] METHOD AND APPARATUS FOR VENTING AIR FROM THE CRANK CASE OF A COMPRESSOR

[75] Inventors: Paulo Paim Brascher F.; Denis José Soncini, both of Joinville, Brazil

[73] Assignee: Schulz S.A., Joinville, Brazil

[21] Appl. No.: 758,674

[22] Filed: Dec. 2, 1996

[51] Int. Cl.[6] ..... F15B 21/04

[52] U.S. Cl. ..... 92/82; 417/435

[58] Field of Search ..... 92/78, 79; 417/437, 417/313

[56] References Cited

U.S. PATENT DOCUMENTS

| | | | |
|---|---|---|---|
| Re. 17,298 | 5/1929 | Hele-Shaw et al. | 92/79 X |
| 3,352,485 | 11/1967 | Niki et al. | 92/79 X |
| 3,844,688 | 10/1974 | Bulkley et al. . | |
| 4,392,788 | 7/1983 | Nakamura et al. . | |
| 4,582,468 | 4/1986 | Bar . | |
| 4,887,514 | 12/1989 | Schintgen . | |
| 5,363,742 | 11/1994 | Yuda . | |

FOREIGN PATENT DOCUMENTS

| | | | |
|---|---|---|---|
| 2462385 | 1/1977 | Germany | 92/78 |

*Primary Examiner*—Hoang Nguyen

*Attorney, Agent, or Firm*—Merchant, Gould, Smith, Edell, Welter & Schmidt, P.A.

[57] ABSTRACT

A downwardly opening compartment is disposed within a crank case. An upwardly disposed hole places the compartment in fluid communication with the environment. As blowby mist in the crank case travels upward through the compartment, the mist tends to separate into oil and air. The oil tends to drain back down into the crank case, and the air tends to continue upward and through the hole.

20 Claims, 10 Drawing Sheets

METHOD AND APPARATUS FOR VENTING AIR FROM THE CRANK CASE OF A COMPRESSOR

FIELD OF THE INVENTION

The present invention relates to compressors and in particular, to accommodation of blowby mist generated during operation of a compressor.

BACKGROUND OF THE INVENTION

In self-contained motorized compressor units for compressing air and other gases, it is conventional to collect lubricating oil within the crank case of the compressor. The oil is then fed under pressure to portions of the compressor for proper lubrication of the moving parts during operation. In reciprocating compressors, a piston normally reciprocates along the axis of a fixed cylinder and carries one or more piston rings which tend to retain some amount of the oil between the stationary cylinder walls and the reciprocating piston. During compression of the air, by reciprocation of the piston, the developed air pressure, regardless of the fit between the piston or rings and the compressor results in gas "blowby" which increases gas pressure within the crank case in the absence of a venting arrangement. Two such arrangements are disclosed in U.S. Pat. No. 3,844,688 to Bulkley et al.

One prior art method of venting the crank case consists of placing the crank case in fluid communication with the air intake manifold of the compressor head. FIG. 17 illustrates one specific prior art arrangement for venting the crank case to the incoming gas to be compressed. The gas compressor identified generally at 10, which is only partially shown, comprises a housing 12, including an end wall 14 at its right-hand end. The end wall 14 supports a compressor crank shaft 18, which is mounted by means of journal bearing 16 for rotation about a horizontal axis. The crank shaft 18 is supplied with one or more connecting rods 20, each of which supports a piston 22 mounted for reciprocation within a stationary cylinder 24 formed integrally within the housing 12. Each piston 22 carries an oil ring 23.

The head of the piston 22 defines a working chamber 25 between the head of the piston and a valve plate 26 which lies intermediate of the housing 12 and the head 27 of the compressor. In this respect, the head 27 defines, for each piston and cylinder combination separate fluid passages in the form of an intake manifold 28 and an exhaust manifold 30. Communication between manifolds 28 and 30 and the working chamber 25 is controlled by valves (not shown) associated with the valve plate 26 for each cylinder. In this respect, however, a port or opening 32 permits fluid communication between intake manifold 28, for instance, and the chamber 25. Oil 40 generally accumulates to the level shown within the crank case 38 beneath the crank shaft 18.

The housing 12 is further provided with an attached end plate 42 which further carries a journal bearing 44 for additionally supporting the crank shaft 18. The plate 42 is bolted to the housing 12 by means of a number of bolts 46 and effects a fluid sealed connection therewith. The plate 42 and the end wall 14 cooperate to define an air intake passage 47. The end plate 42 effectively acts to maintain a vertical suction screen 49 disposed to separate a passage 47 formed by the housing 12 and the end plate 42 into inner and outer chambers 48 and 50, respectively.

Assuming that the gas being compressed is air, the air enters the air compressor through an air inlet fitting 52 on the outer chamber 50 and passes through a suction screen to enter the inner chamber 48. A coalescent separator 70, consisting of a perforated annular plate 71 and a felt annulus 73, separates oil and other liquids carried by the incoming gas stream A. The end wall 14 of the housing 12 is provided with a downwardly disposed opening 34 that receives a check valve 36 which, in turn, permits oil to drain into the bottom of the crank case 38. The end wall 14 of the housing 12 is further provided with an upwardly disposed port 56, lying well above the level of the lube oil 40. The port 56 permits the oil-air mist M within the crank case 38 to merge with the incoming air stream A, within inner chamber 48. Further, aligned openings 58 and 60 in the housing 12 and the valve plate 26, respectively, permit the incoming air and the oil-air mist emanating from port 56 to enter the intake manifold 28 for compression by the reciprocation of piston 22. Unless the oil is recovered after compression exterior of the compressor, the oil supply available to the compressor is rapidly reduced.

A second prior art compressor is shown in FIG. 18, wherein like reference numerals represent like ports and assemblies. The compressor 10' includes a housing 12 having an end wall 14 which cooperates with head 27 to define a crank case 38 within which oil 40 rises to a given level. Again, the end wall 14 carries a journal bearing 16 supporting the crank shaft 18 for rotation about a horizontal axis. The crank shaft 18 is connected via connecting rod 20 to a piston 22 which reciprocates along its vertical axis within cylinder 24 in similar manner to the other prior art compressor. An end plate 42 cooperates with the end wall 14 of the housing 12 to define dual chambers 48 and 50, which are separated by coalescent separator 70.

The coalescent separator 70 in the compressor 10' comprises a perforated annular plate 71 which is sandwiched between the housing 12 and the end plate 42. On the side of the chamber 50, the separator 70 provides a felt annulus 73 which permits oil to be removed from the oil mist during passage from chamber 48 to chamber 50. The removed oil drains through check valve 36 and into the crank case 38.

The end plate 42 is provided with a journal bearing 44 further supporting the outer end of the crank shaft 18. The end plate 42 is coupled to the housing 12 by a series of bolts 46 in a fluid sealed manner.

The compressor 10' has a modified valve plate 72, which effectively covers the passage or opening 58 within the housing 12 normally leading to intake manifold 28. Plate 72 is provided with a port at 32 permitting fluid connection between intake manifold 28 and the working chamber defined by the head of piston 22, the wall of cylinder 24, and the modified valve plate 72. The intake and exhaust valves for the compressor are not shown. A fitting 74 couples the chamber 50 to a tube 76 which ports directly to the intake manifold 28. The tube 76 acts as the air inlet to the compressor 10' (assuming air is the working fluid of the compressor). The crank case vent line indicated schematically at 78 is a small diameter tube leading from fitting 74 to the air inlet tube 76. Thus, the modified valve plate 72 effectively blocks the chamber 48 from direct access to the intake manifold, except via chamber 50 and tube 78. The modified head 27 is not contaminated by the oil-air mist emanating from the crank case through check valve 36 leading into the inner chamber 48. The air leakage past the piston ring 23 and conventionally termed "gas blowby" creates an oil-gas mist which vents to the head 27 only after passage through the inner chamber 48. Oil from the mist may be deposited on the coalescent separator 70, whereupon the oil drains into the bottom of these chambers and passes through check valve 36 back into the crank case 38.

Problems can arise with compressors of the type described above. In particular, coalescing filters tend to create back-pressure and restriction within the crank case, thereby causing oil to pass through the rings and valves, particularly as the filter becomes dirty. Also, recycled hot air tends to affect adiabatic air compression, thereby reducing efficiency in compression and power consumption.

The present invention accommodates gas blowby in a manner which is cost effective in terms of both manufacture and maintenance. The present invention does not require a coalescing filter to remove oil from the mist and thus, the present invention avoids the problems associated therewith. Moreover, the present invention does not return hot air to the compressor inlet valves and thus, avoids the problems associated therewith.

SUMMARY OF THE INVENTION

The present invention provides methods and apparatus for accommodating blowby gas or mist generated during operation of a compressor. The invention provides a downwardly opening compartment within a crank case and a breather orifice within the upper confines of the compartment. The blowby mist tends to separate into oil and air as it travels up the compartment. The oil tends to drain back into the crank case, while the air tends to continue upward and through the breather orifice. Baffles may be disposed within the compartment to encourage this separation process.

The invention accommodates the blowby mist in a manner that tends to reduce on-going oil loss and the formation of an oil crust on or around the compressor. The invention also tends to improve operational efficiency in a relatively cost effective manner. At least some of the advantages of the present invention will become apparent to those skilled in the art upon a more detailed description of the preferred embodiment.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
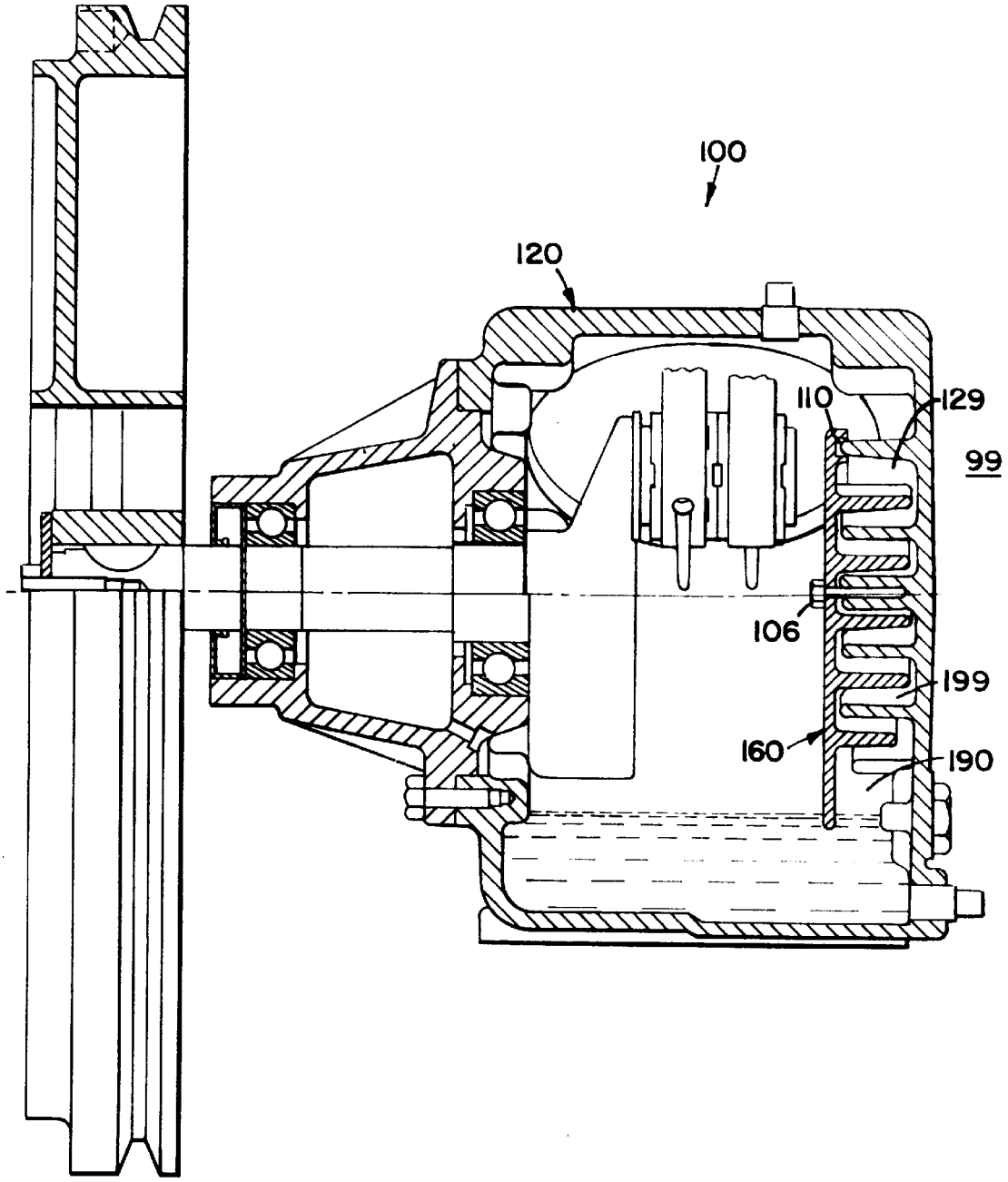
FIG. 1 is a sectioned side view of an air compressor constructed according to the principles of the present invention.
Figure 2:
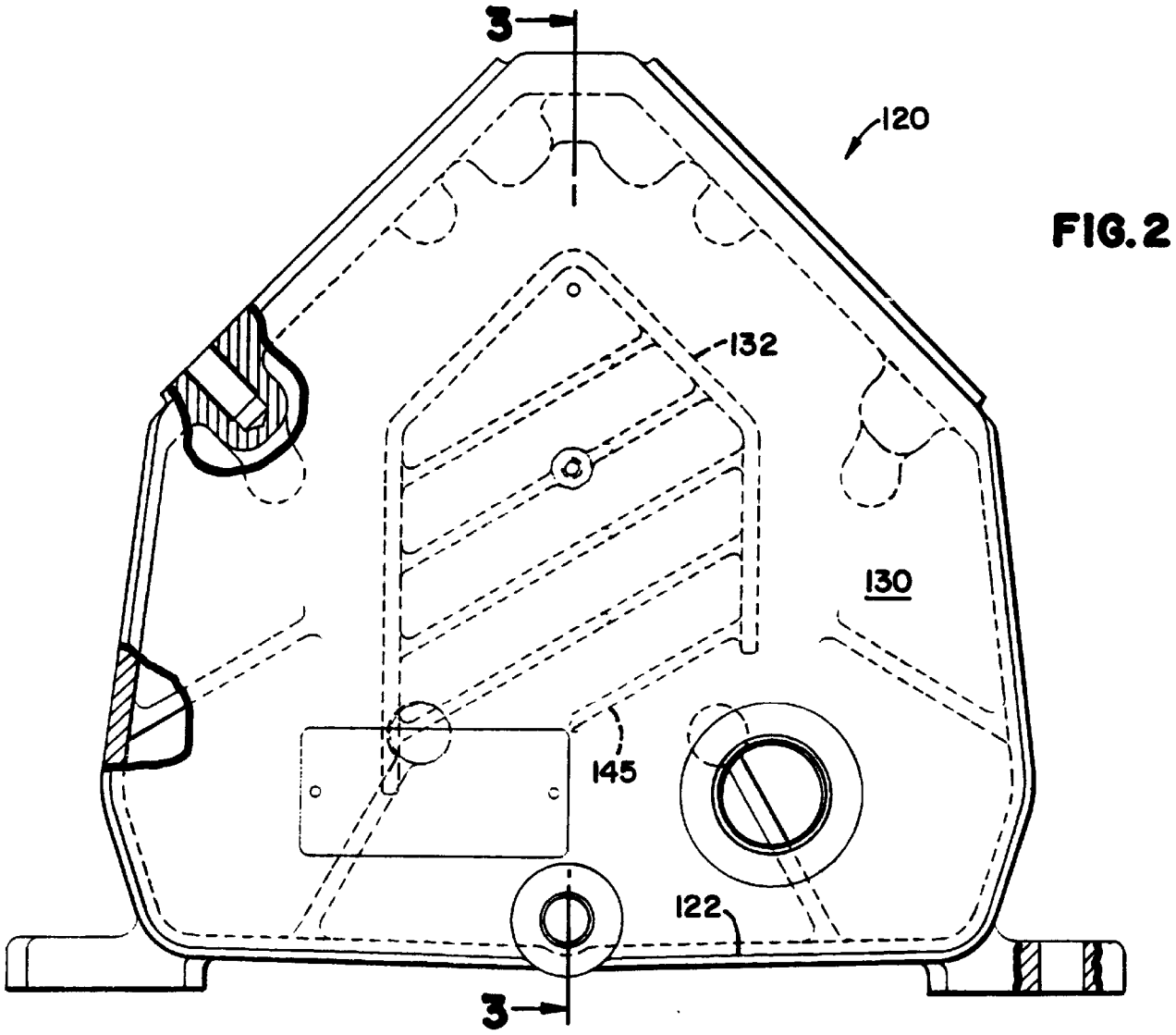
FIG. 2 is an end view of a crank case forming a part of the compressor of FIG. 1.
Figure 3:
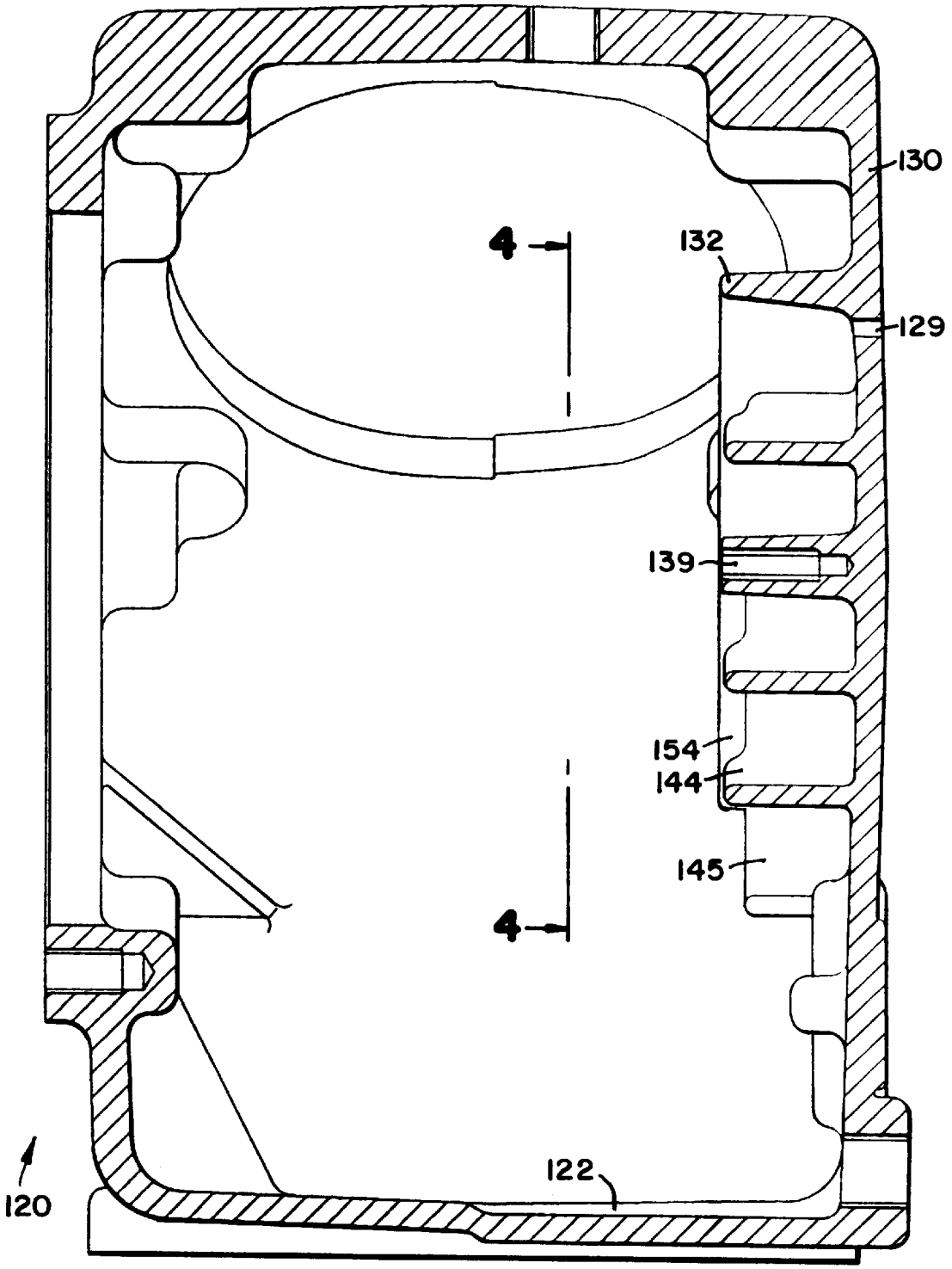
FIG. 3 is a sectioned view of the crank case of FIG. 2, taken along the line 3—3.
Figure 5:
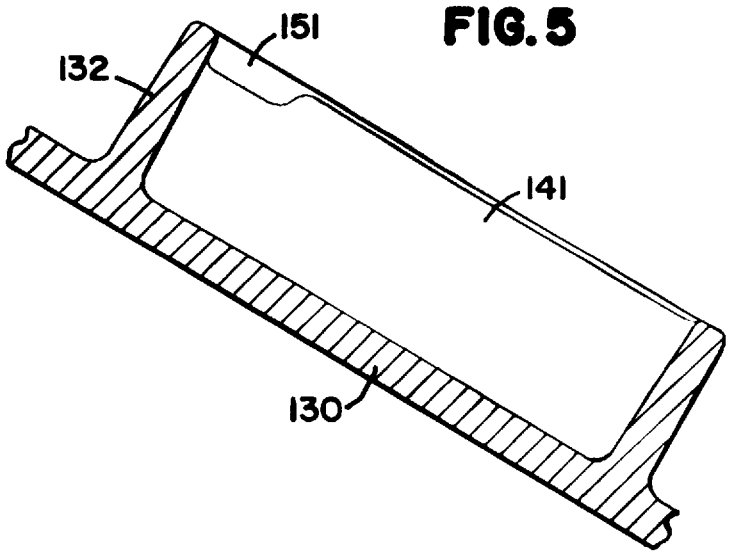
FIG. 5 is a sectioned view of the internal portion of FIG. 4, taken along the line 5—5.
Figure 4:
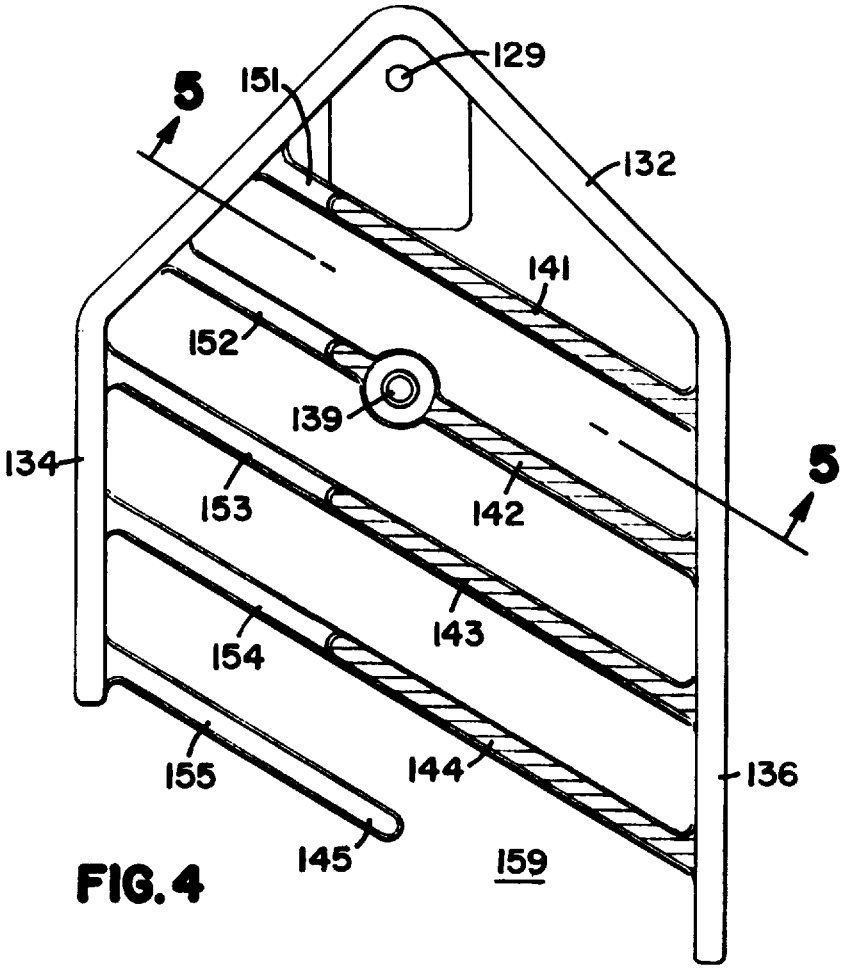
FIG. 4 is an end view of an internal portion of the crank case of FIG. 3, taken along the line 4—4.

An air compressor constructed according to the principles of the present invention is designated as 100 in FIG. 1. The compressor 100 includes, among other things, a crank case 120 and an internal plate 160. The crank case 120 and the internal plate 160 cooperate to provide a novel venting arrangement by which "blowby" gas may be vented from the crank case 120. Though described with reference to an air compressor, the present invention is applicable to other sorts of compressors and/or crank cases, as well.

The crank case 120 is shown in greater detail in FIGS. 2–5. Many of the features of the crank case 120 are well known in the art and thus, not described herein. In general, the crank case 120 may be described as a housing which includes a bottom 122 and an end wall 130. Structure on the end wall 130 protrudes inward into the interior of the crank case 120. The structure may be described as an internal wall 132 which is generally shaped like an inverted V. In other words, the internal wall 132 is open at the bottom or opens toward the bottom 122 of the crank case 120, and the wall 132 is closed at the top or converges to form an upwardly disposed vertex. A relatively small hole 129 is formed through the end wall 130 within the confines of the internal wall 132 and proximate its vertex.

Parallel baffles 141–144 extend between opposing sides of the wall 132, at an angle of approximately 30 degrees relative to the bottom 122 of the crank case 120. Each of the baffles 141–144 spans substantially the entire distance or gap between opposite sides of the wall 132, providing only relatively small openings 151–154, respectively, disposed proximate a shorter side 134 of the wall 132 and remote from the end wall 130. A lowermost baffle 145 extends from the shorter side 134 of the wall 132 and parallel to the other baffles 141–144. The lowermost baffle 145 spans only about half the gap between the opposing sides of the wall 132, providing a void 159 between the distal end of the baffle 145 and the longer side 136 of the wall 132, as well as a relatively small opening 155 disposed in general alignment with the openings 141–144. The baffles 141–145 also cooperate with the internal plate 160 to define slits which are significantly narrower than the openings 151–155 and span the entire distance between the opposite sides of the wall 132.

Figure 6:
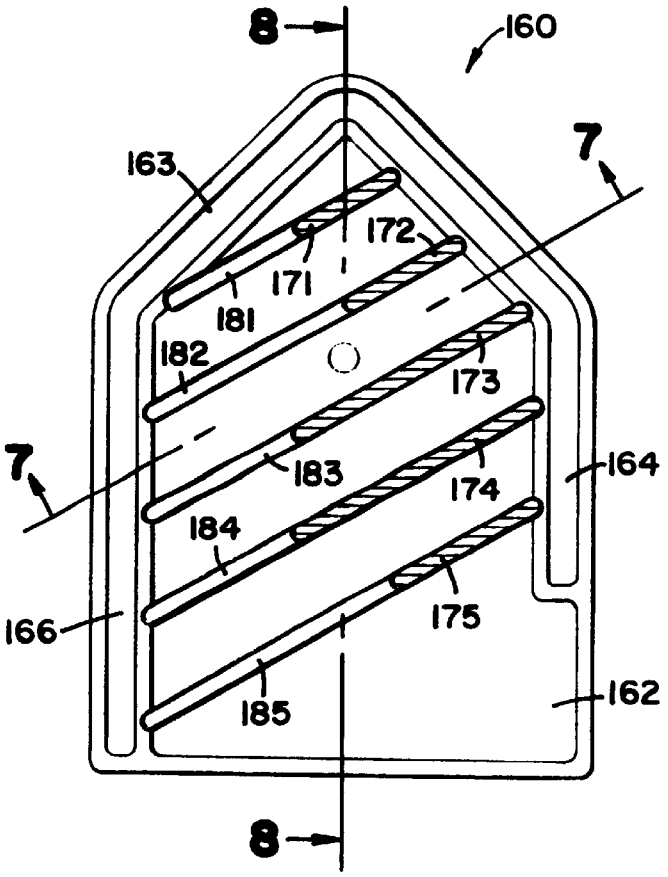
FIG. 6 is an end view of an internal plate forming a part of the compressor of FIG. 1.
Figure 7:
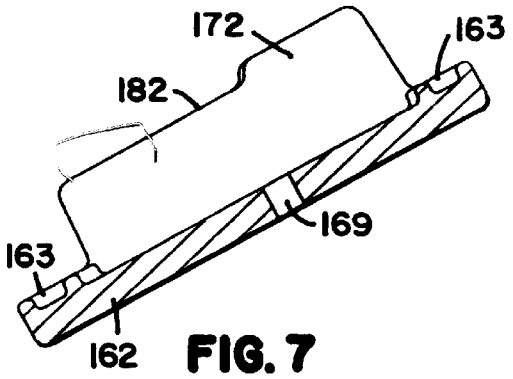
FIG. 7 is a sectioned view of the internal plate of FIG. 6, taken along the line 7—7.
Figure 8:
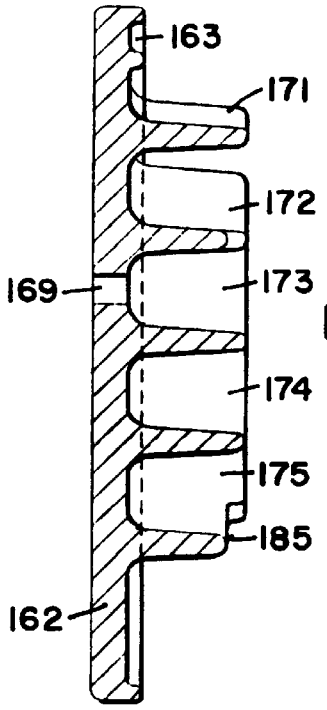
FIG. 8 is a sectioned view of the internal plate of FIG. 6, taken along the line 8—8.

An inwardly opening socket 139 is provided proximate the midpoint of the second highest baffle 142 to receive a fastener 106 and thereby facilitate connection of the internal plate 160 to the crank case 120. The internal plate 160 is shown in greater detail in FIGS. 6–8. The internal plate 160 includes a panel 162 which is sized and configured to overlie the internal wall 132. A groove 163 is formed in the panel 162 to mate with the internal wall 132 on the crank case 120. A hole 169 is formed through the panel 162 to align with the socket 139 when the groove 163 and the internal wall 132 are interengaged. The hole 169 allows all but the head of the fastener 106 to pass through the panel 162 and into the socket 139, once a seal or sealant 110 has been disposed within the groove 163. In this manner, the internal plate 160, the internal wall 132, and the end wall 130 may be said to cooperate to provide a downwardly opening compartment 190.

Parallel baffles 171–175 extend between opposite sides of the panel 162, at an angle of approximately 30 degrees relative to the bottom 122 of the crank case 120. Each of the baffles 171–175 spans substantially the entire gap or distance between the opposite sides of the groove 163, providing only relatively small openings 181–185, respectively, disposed proximate the relatively longer side 166 of the groove 163 and remote from the panel 162. The baffles 171–175 also cooperate with the end wall 130 to define slits which are significantly narrower than the openings 181–185 and span the entire distance between the opposite sides of the groove 163.

The baffles 171–175 cooperate with the baffles 141–145 to provide a conduit or labyrinth 199 through which "blowby" mist of air/oil may travel from the crank case 120 to the environment 99 or some discrete chamber. As the blowby mist travels through the conduit 199, oil within the mist tends to separate from the gas, collect on the baffles or walls 141–145 and 171–175, and drain back down into the bottom 122 of the crank case 120. In this regard, the oil in the mist impacts against the baffles or walls of the conduit 199, and the mist is also forced to change directions as it traverses the conduit, thereby experiencing centrifugal forces, as well. On the other hand, the air within the mist tends to continue upward and out the hole 129. As a result, the present invention tends to vent the potentially harmful hot air from the system while retaining the desirable oil.

Figure 10:
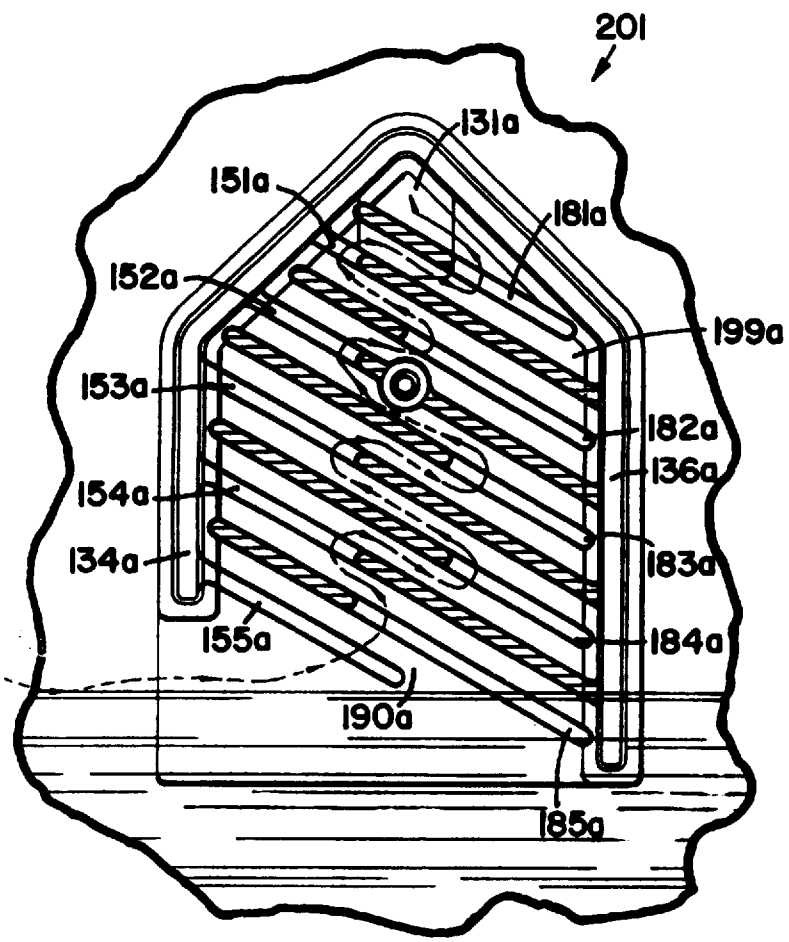
FIG. 10 is a sectioned end view of the crank case assembly of FIG. 9.
Figure 9:
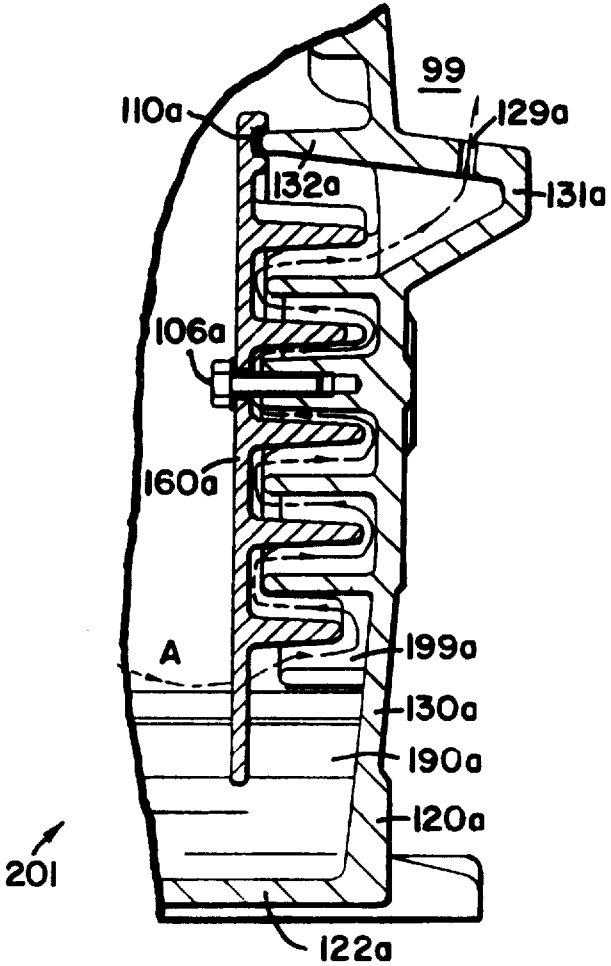
FIG. 9 is a sectioned side view of an alternative embodiment crank case assembly constructed according to the principles of the present invention.

An alternative embodiment of the present invention is designated as 201 in FIGS. 9–10. This embodiment 201 is very similar to the preferred embodiment 100. Among other things, this alternative embodiment 201 similarly includes a crank case 120*a* having a bottom 122*a* and an end wall 130*a*. However, the hole 129*a* is formed through an outwardly protruding section 131*b* of the end wall 130*a* (which is unlike the preferred embodiment). As on the preferred embodiment, an internal wall 132*a* protrudes into the crank case 120*a*, and an internal plate 160*a* is secured to the internal wall 132*a* by means of a fastener 106*a* and a seal 110*a*. The internal plate 160*a*, the internal wall 132*a*, and the end wall 130*a* cooperate to define a downwardly opening compartment 190*a*. Baffles on the internal plate 160*a* and on the end wall 130*a* cooperate to define a conduit 199*a* through the compartment 190*a*, from the crank case 120*a* to the environment 99, like that on the preferred embodiment.

The flow of blowby mist along the conduit 199*a* (and/or the conduit 199) is depicted by arrow paths A. The flow path of the departing mist begins at the opening 155*a*; then proceeds up and toward both the end wall 130*a* and the longer wall segment 136*a* to pass through the opening 185*a*; then up and toward both the internal plate 160*a* and the shorter wall segment 134*a* to pass through the opening 154*a*; then down and toward both the end wall 130*a* and the longer wall segment 136*a* to pass through the opening 184*a*; then up and toward both the internal plate 160*a* and the shorter wall segment 134*a* to pass through the opening 153*a*; then down and toward both the end wall 130*a* and the longer wall segment 136*a* to pass through the opening 183*a*; then up and toward both the internal plate 160*a* and the shorter wall segment 134*a* to pass through the opening 152*a*; then down and toward both the end wall 130*a* and the longer wall segment 136*a* to pass through the opening 182*a*; then up and toward both the internal plate 160*a* and the shorter wall segment 134*a* to pass through the opening 151*a*; then down and toward both the end wall 130*a* and the longer wall segment 136*a* to pass through the opening 181*a*; and finally, into the protrusion 131*b* and out the hole 129*a* (or simply out the hole 129). The conduit 199*a* encourages oil to separate from the mist and travel back down the compartment 190*a*, while allowing the air in the mist to continue upward through the hole 129*a*.

Figure 12:
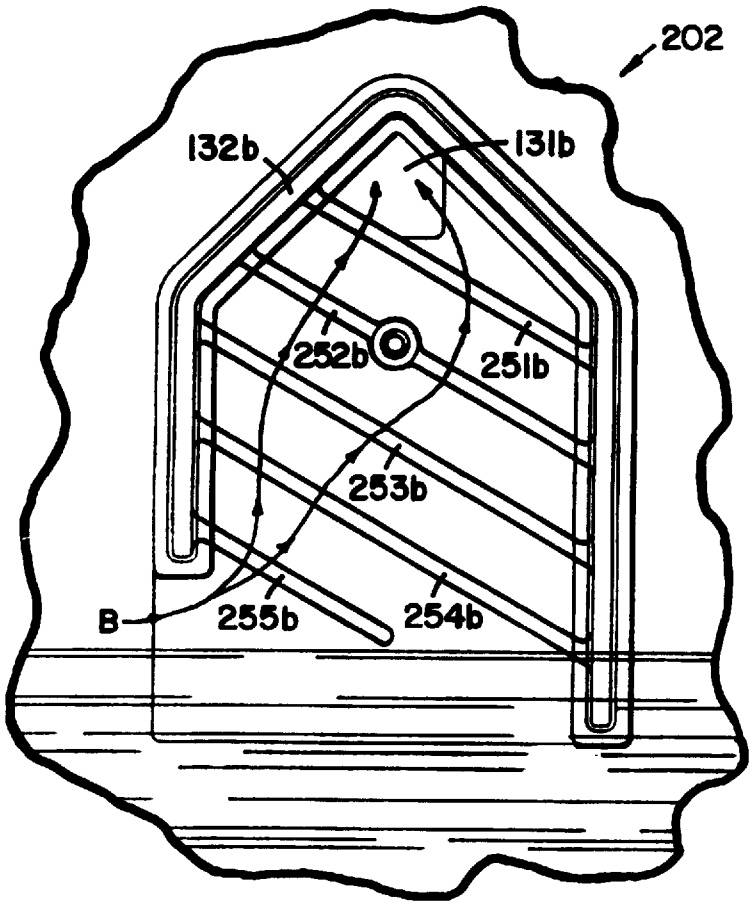
FIG. 12 is a sectioned end view of the crank case assembly of FIG. 11.
Figure 11:
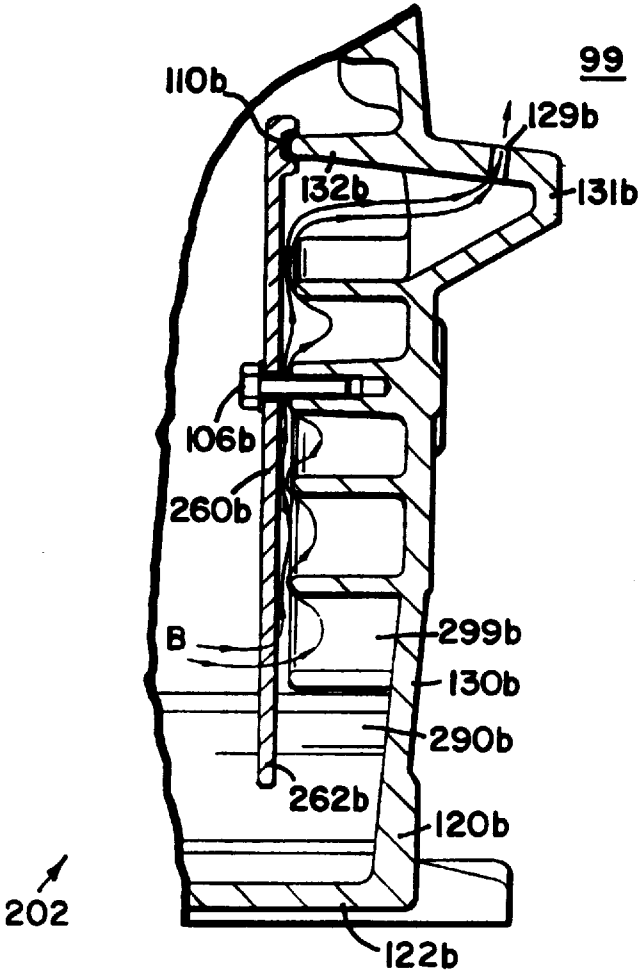
FIG. 11 is a sectioned side view of another alternative embodiment crank case assembly constructed according to the principles of the present invention.

Another alternative embodiment of the present invention is designated as 202 in FIGS. 11–12. The crank case 120*b* is identical to the crank case 120*a* of the first alternative embodiment 201. In other words, this alternative embodiment 200*a* likewise includes a crank case 120*b* having a bottom 122*b* and an end wall 130*b*. A hole 129*b* is formed through an outwardly protruding section 131*b* of the end wall 130*b*. An internal wall 132*b* protrudes into the crank case 120*b*, and baffles extend between opposite sides of the internal wall 132*b*. The internal plate 260*b* is different than those of the previous embodiments. In particular, the internal plate 260*b* includes a panel 162*b* but no baffles. The panel 162*b* is secured to the internal wall 132*b* by means of a fastener 106*b* and a seal 110*b*. The internal plate 260*b*, the internal wall 132*b*, and the end wall 130*b* cooperate to define a downwardly opening compartment 290*b*. The baffles on the end wall 130*b* cooperate with the plate 260*b* to define a plurality of parallel slits 251*b*–255*b* and a conduit 299*b*. The blowby mist travels along the flow paths B from the crank case 120*b*, through the slits 251*b*–255*b*, into the protrusion 131*b*, out the hole 129*b*, and into the environment 99. Again, the baffles are provided to facilitate separation of oil from the mist.

Figure 14:
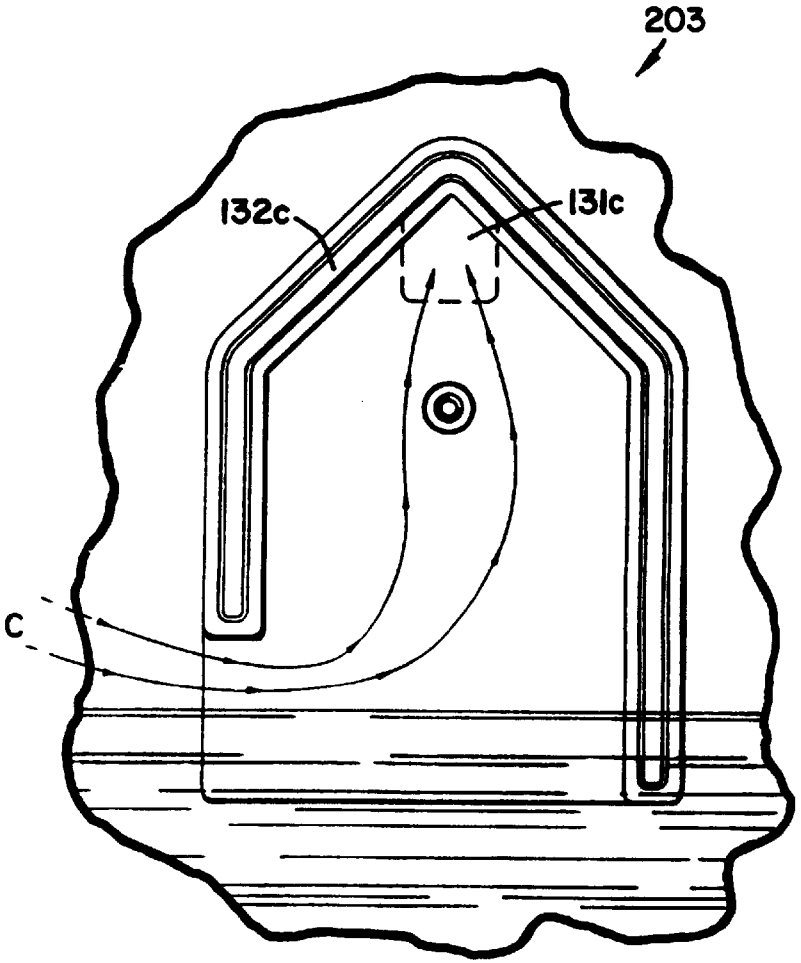
FIG. 14 is a sectioned end view of the crank case assembly of FIG. 13.
Figure 13:
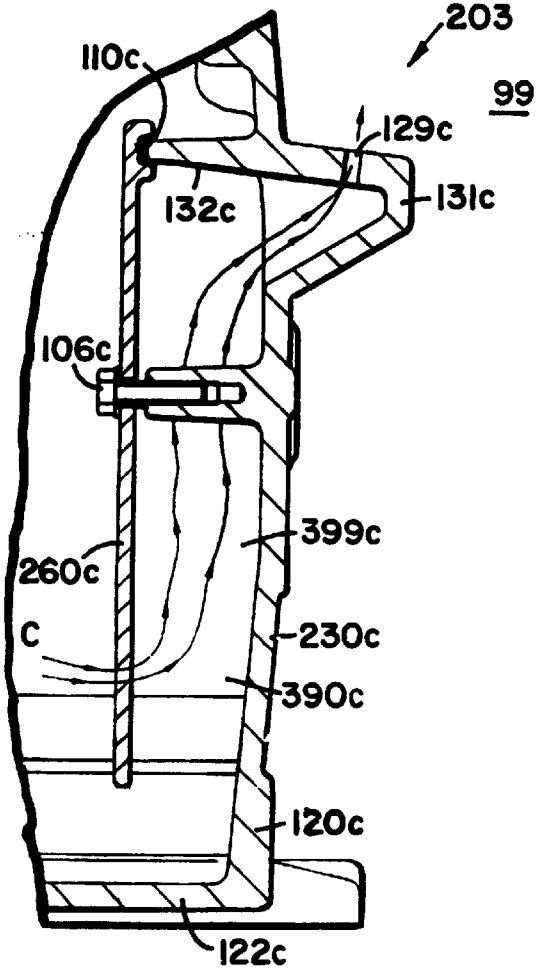
FIG. 13 is a sectioned side view of yet another alternative embodiment crank case assembly constructed according to the principles of the present invention.

A fourth embodiment of the present invention is designated as 203 in FIGS. 13–14. This embodiment 203 includes a crank case 120*c* having a bottom 122*c* and an end wall 230*c*. A hole 129*c* is formed through an outwardly protruding section 131*c* of the end wall 230*c*. An internal wall 132*c* protrudes into the crank case 120*c*, but there are no baffles. An internal plate 260*c*, identical to that on the embodiment 202 discussed in the preceding paragraph, is secured to the internal wall 132*c* by means of a fastener 106*c* and a seal 110*c*. The internal plate 260*c*, the internal wall 231*c*, and the end wall 230*c* cooperate to define a downwardly opening compartment 390*c*. Blowby mist travels through the conduit 399*c* within the compartment 390*c* to escape the crank case 120*c* and enter the environment 99 via the hole 129*c*. Gravity, temperature drop, and contact between the mist and the walls of the compartment 390*c* all tend to encourage oil to separate from the mist.

Figure 16:
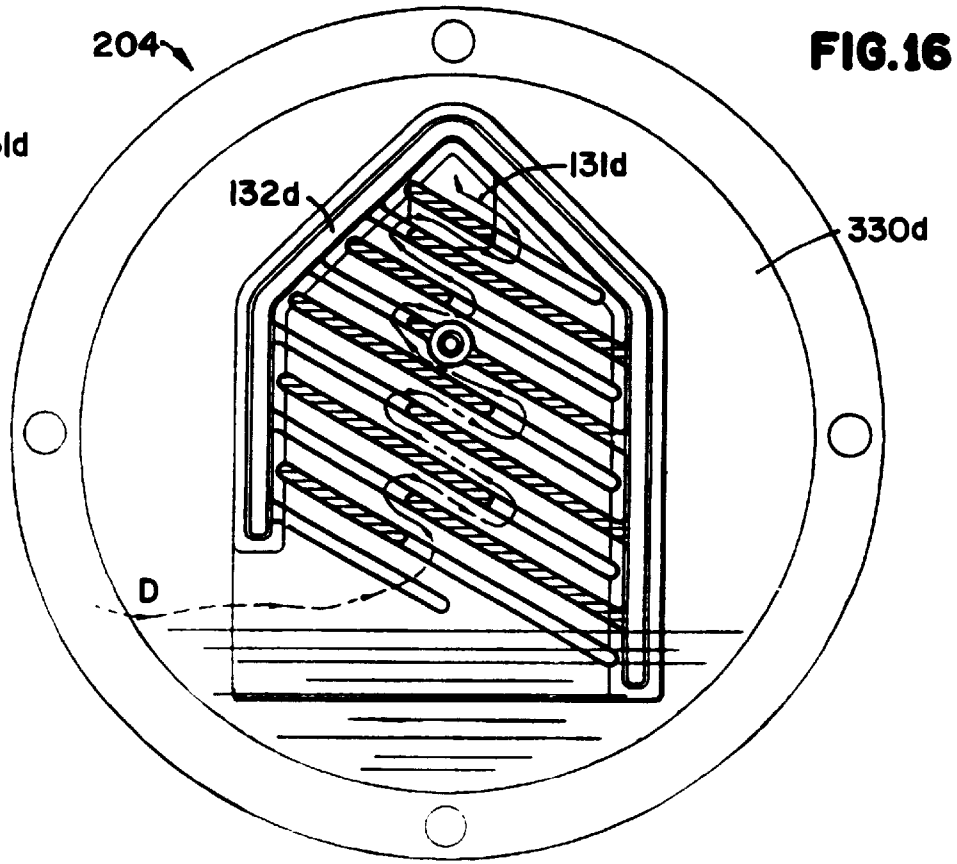
FIG. 16 is a sectioned end view of the crank case assembly of FIG. 15.
Figure 15:
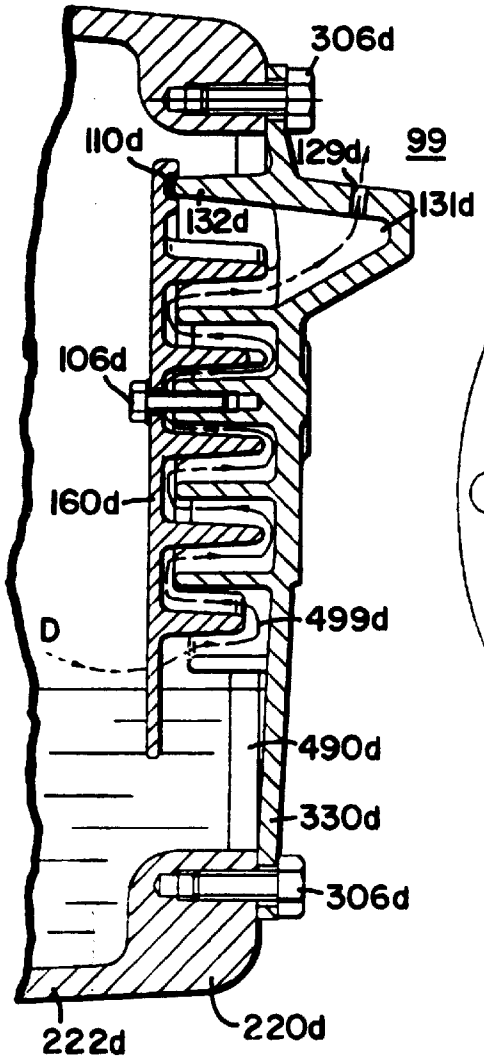
FIG. 15 is a sectioned side view of still another alternative embodiment crank case assembly constructed according to the principles of the present invention.
Figure 17:
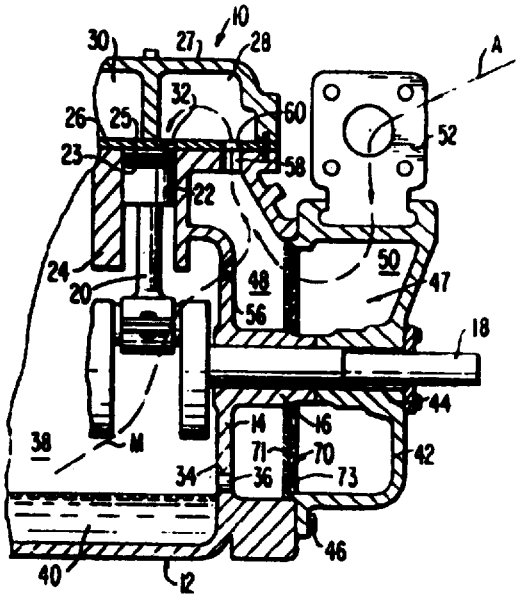
FIG. 17 PRIOR ART
FIG. 17 is a sectioned side view of a first prior art compressor.
Figure 18:
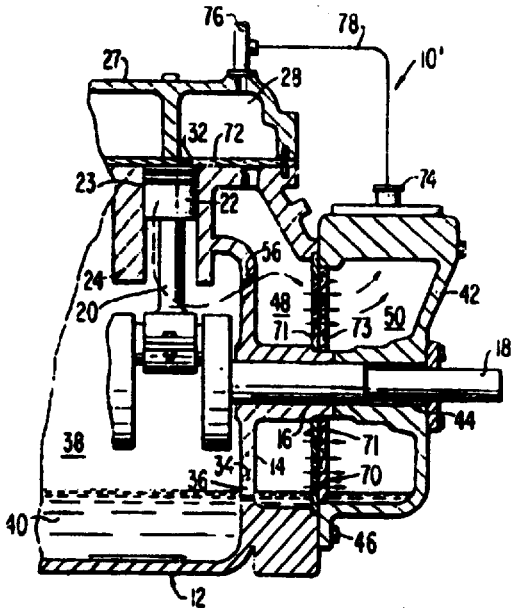
FIG. 18 PRIOR ART
FIG. 18 is a sectioned side view of a second prior art compressor.

Yet another alternative embodiment is designated as 204 in FIGS. 15–16. This embodiment 204 is similar in many respects to the first alternative embodiment 201, shown in FIGS. 9–10. However, the end wall 330*d* is a discrete part on this alternative embodiment 204, rather than an integrally formed portion of the crank case 220*d*. The end wall 330*d* is secured to the crank case 220*d* by means of bolts 306*d*. Like the first alternative embodiment 201, this embodiment includes a crank case 220*d* having a bottom 222*d* and an end wall 330*d*. A generally horizontal protrusion 131*d* is formed in the discrete end wall 330*d*, and a generally vertical hole 129*d* is formed through an upper portion of the protrusion 131*d*.

An internal wall 132*d* protrudes into the crank case 220*d*, and an internal plate 160*d* is secured thereto by means of a bolt 106*d* and a seal 110*d*. The internal plate 160*d*, the internal wall 132*d*, and the end wall 330*d* cooperate to define a downwardly opening compartment 490*d*. Baffles on both the internal plate 160*d* and the end wall 330*d* cooperate to define a serpentine conduit 499*d*. Blowby mist travels along a flow path D, from the crank case 220*d*, through the conduit 499*d*, where the oil and air in the mist tend to separate. The oil tends to drain back down into the crank case 220*d*, while the air tends to continue upward into the protrusion 131*d*, out the hole 129*d*, and into the environment 99.

The present invention may also be seen to provide methods of accommodating blowby mist generated during operation of a compressor. For example, air may be separated from oil and vented from the crank case by providing a downwardly opening compartment within the crank case; and providing a hole through the crank case, located upwardly within the compartment, to place the compartment in fluid communication with the environment or a discrete chamber.

One or more baffles may be provided within the compartment and downward from the hole to facilitate separation of the air and oil. The baffles may be provided at an angle of approximately thirty degrees relative to horizontal, encouraging the separated oil to drain back down into the crank case. The baffles may be arranged in such a manner that air within the crank case must alternatively travel up and down in order to reach the hole. The baffles may also be arranged in such a manner that air within the crank case must alternatively travel back and forth in either and/or each of two generally horizontal directions which are generally perpendicular to each other.

A generally horizontal protrusion may be formed in the end wall of the crank case, so that a generally vertical venting hole may be provided in lieu of a generally horizontal hole.

Although the present invention has been described with reference to particular embodiments and a specific application, those skilled in the art will recognize other embodiments and applications that fall within the scope of the present invention. As a matter of practicality, only a few of the possibilities are shown and/or described herein. Accordingly, the present invention is to be limited only to the extent of the appended claims.

What is claimed is:

1. A method of venting air from within a crank case, comprising the steps of:

providing a downwardly opening compartment within the crank case; and providing a hole through the crank case, located upwardly within the compartment, to place the compartment in fluid communication with a vent accommodating environment.

2. The method of claim 1, further comprising the step of providing at least one baffle within the compartment and downward from the hole.

3. The method of claim 2, wherein the at least one baffle is provided at an angle of approximately thirty degrees relative to horizontal.

4. The method of claim 1, further comprising the step of providing baffles within the compartment and downward from the hole.

5. The method of claim 4, wherein the baffles are provided in such a manner that air within the crank case must alternatively travel up and down in order to reach the hole.

6. The method of claim 5, wherein the hole is provided through a wall of the crank case, and the baffles are provided in such a manner that air within the crank case must alternatively travel toward and away from the wall in order to reach the hole.

7. The method of claim 1, wherein the hole is provided through a wall of the crank case, and the baffles are provided in such a manner that air within the crank case must alternatively travel toward and away from the wall.

8. The method of claim 1, further comprising the step of providing a horizontal wall on the crank case, through which the hole is provided.

9. The method of claim 1, further comprising the step of providing a first switchback within the compartment and downward from the hole.

10. The method of claim 9, further comprising the step of providing a second switchback within the compartment and between the first switchback and the hole, such that the second switchback and the first switchback lie in generally perpendicular planes.

11. A compressor, comprising:

a crank case having a first wall;

a panel;

a second wall extending generally perpendicularly between the first wall and the panel and cooperating therewith to define a downwardly opening compartment; and a hole formed through the first wall and located upwardly within the compartment.

12. The compressor of claim 11, further comprising at least one baffle disposed beneath the hole and secured to one of the first wall and the panel.

13. The compressor of claim 11, further comprising a first baffle disposed beneath the hole and secured to the first wall, and a second baffle disposed between the hole and the first baffle and secured to the panel.

14. The compressor of claim 13, wherein the first baffle limits access from the crank case to the second baffle along a first side of the compartment, and the second baffle limits access from the first baffle to the hole along a second, opposite side of the compartment.

15. The compressor of claim 14, wherein the first baffle limits access from the crank case to the second baffle along a first end of the compartment, and the second baffle limits access from the first baffle to the hole along a second, opposite end of the compartment.

16. The compressor of claim 13, wherein the first baffle and the second baffle cooperate to encourage air in the crank case to travel alternatively up and down in order to reach the hole.

17. The compressor of claim 13, wherein the first baffle and the second baffle extend parallel to one another an at an acute angle relative to horizontal.

18. The compressor of claim 13, wherein a first notch is formed in the first baffle proximate a first side of the compartment and remote from the first wall, and a second notch is formed in the second baffle proximate a second, opposite side of the compartment and remote from the panel.

19. The compressor of claim 11, wherein the second wall is integrally connected to the first wall, and the panel is connected to the second wall by means of a seal and a bolt.

20. The compressor of claim 11, wherein the hole is formed through a portion of the first wall extending generally horizontal.

* * * * *